US006418559B1

(12) United States Patent
Wrecsics et al.

(10) Patent No.: US 6,418,559 B1
(45) Date of Patent: Jul. 16, 2002

(54) ARTICLE OF CLOTHING

(76) Inventors: Charles M. Wrecsics, 1755 Allentown Rd., Quakertown, PA (US) 18951-3707; Harold Hillegass, Box 14 148 S. Main St., Richlandtown, PA (US) 18955

( * ) Notice: Subject to any disclaimer, the term of this patent is extended or adjusted under 35 U.S.C. 154(b) by 30 days.

(21) Appl. No.: 09/844,763

(22) Filed: Apr. 27, 2001

(51) Int. Cl.[7] ..... A41B 1/12
(52) U.S. Cl. ..... 2/127; 2/202; 2/206
(58) Field of Search ..... 2/424, 127, 123, 2/206, 60, 9, 98, 468, 458, 202

(56) References Cited

U.S. PATENT DOCUMENTS 4,494,246 A * 1/1985 Tillbrook ..... 2/2.1 R
4,944,041 A * 7/1990 Buenos et al. ..... 2/84
5,251,336 A * 10/1993 Nevins ..... 2/202

* cited by examiner

*Primary Examiner*—Rodney M. Lindsey
*Assistant Examiner*—James G Smith

(57) ABSTRACT

A article of clothing for covering the torso and face of a wearer. The article of clothing includes a body covering comprising a torso portion and two sleeve portions fixedly coupled thereto. The torso portion has a neck opening therein. The body covering comprises a cloth material. A mask portion is attached to and extends upwardly from an edge of the neck opening. The mask portion comprises a resiliently flexible cloth material.

6 Claims, 1 Drawing Sheet

ARTICLE OF CLOTHING

BACKGROUND OF THE INVENTION

1. Field of the Invention

The present invention relates to clothing and more particularly pertains to a new article of clothing for covering the torso and face of a wearer.

2. Description of the Prior Art

The use of clothing is known in the prior art. More specifically, clothing heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,628,308; U.S. Pat. No. 4,589,408; U.S. Pat. No. 5,893,432; U.S. Pat. No. 5,251,336; U.S. Pat. No. 5,845,340; and U.S. Pat. No. Des. 323,733.

While these devices fulfill their respective, particular objectives and requirements, the aforementioned patents do not disclose a new article of clothing. The inventive device includes a body covering comprising a torso portion and two sleeve portions fixedly coupled thereto. The torso portion has a neck opening therein. The body covering comprises a cloth material. A mask portion is attached to and extends upwardly from an edge of the neck opening. The mask portion comprises a resiliently flexible cloth material.

In these respects, the article of clothing according to the present invention substantially departs from the conventional concepts and designs of the prior art, and in so doing provides an apparatus primarily developed for the purpose of covering the torso and face of a wearer.

SUMMARY OF THE INVENTION

In view of the foregoing disadvantages inherent in the known types of clothing now present in the prior art, the present invention provides a new article of clothing construction wherein the same can be utilized for covering the torso and face of a wearer.

The general purpose of the present invention, which will be described subsequently in greater detail, is to provide a new article of clothing apparatus and method which has many of the advantages of the clothing mentioned heretofore and many novel features that result in a new article of clothing which is not anticipated, rendered obvious, suggested, or even implied by any of the prior art clothing, either alone or in any combination thereof.

To attain this, the present invention generally comprises a body covering comprising a torso portion and two sleeve portions fixedly coupled thereto. The torso portion has a neck opening therein. The body covering comprises a cloth material. A mask portion is attached to and extends upwardly from an edge of the neck opening. The mask portion comprises a resiliently flexible cloth material.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new article of clothing apparatus and method which has many of the advantages of the clothing mentioned heretofore and many novel features that result in a new article of clothing which is not anticipated, rendered obvious, suggested, or even implied by any of the prior art clothing, either alone or in any combination thereof.

It is another object of the present invention to provide a new article of clothing which may be easily and efficiently manufactured and marketed.

It is a further object of the present invention to provide a new article of clothing which is of a durable and reliable construction.

An even further object of the present invention is to provide a new article of clothing which is susceptible of a low cost of manufacture with regard to both materials and labor, and which accordingly is then susceptible of low prices of sale to the consuming public, thereby making such article of clothing economically available to the buying public.

Still yet another object of the present invention is to provide a new article of clothing which provides in the apparatuses and methods of the prior art some of the advantages thereof, while simultaneously overcoming some of the disadvantages normally associated therewith.

Still another object of the present invention is to provide a new article of clothing for covering the torso and face of a wearer.

Yet another object of the present invention is to provide a new article of clothing which includes a body covering comprising a torso portion and two sleeve portions fixedly coupled thereto. The torso portion has a neck opening therein. The body covering comprises a cloth material. A mask portion is attached to and extends upwardly from an edge of the neck opening. The mask portion comprises a resiliently flexible cloth material.

Still yet another object of the present invention is to provide a new article of clothing that allows a wearer to forgo having to bring two articles of clothing, namely a facemask and shirt, when skiing, snowmobiling or the like.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
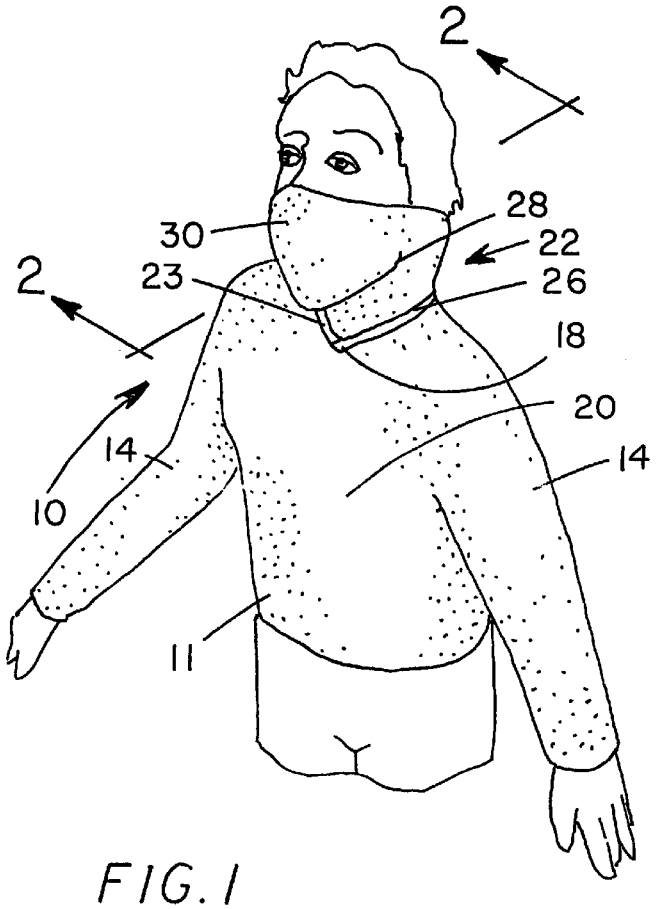
FIG. 1 is a schematic perspective view of a new article of clothing according to the present invention.
Figure 2:
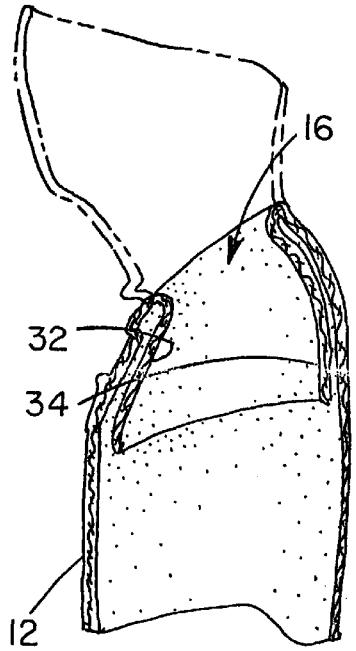
FIG. 2 is a schematic cross-sectional view taken along line 2—2 of FIG. 1 of the present invention.

With reference now to the drawings, and in particular to FIGS. 1 and 2 thereof, a new article of clothing embodying the principles and concepts of the present invention and generally designated by the reference numeral 10 will be described.

As best illustrated in FIGS. 1 and 2, the article of clothing 10 generally comprises a body covering 11 having a torso portion 12 and two sleeve portions 14 fixedly coupled thereto. The torso portion 12 has a neck opening 16 therein. The neck opening 16 tapers to a point 18 in a chest portion 20 of the torso portion 12 such that the neck opening 16 has a teardrop shape. The body covering 11 comprises a cloth material, which is preferably selected from the group consisting of wool, cloth, and spandex.

A mask portion 22 is attached to and extends upwardly from an edge 23 of the neck opening 16. The mask portion 22 comprises a resiliently flexible cloth material selected from the group consisting of cotton, wool and spandex. The mask portion 22 includes a tubular member 24 having a first end 26 and a second end 28. The first end 26 of the tubular member extends along and is attached to the edge 23 of the neck opening 16. The tubular member 24 has a length extending from first to the second end preferably between 2 inches and 4 inches.

A face portion 30 is attached to and extends upwardly from the second end 28 of the tubular member 24. The face portion 30 is adapted to cover at least the nose, mouth, cheekbones and lower back head area of a wearer. The face portion 30 is generally bowl-shaped and opens outwardly as it extends away from the tubular member. Ideally, the face portion 30 has a front side 32 extending further away from the tubular member then a back side 34 of the face portion.

In use, the article of clothing is worn as conventional clothing. A wearer who is skiing or snowmobiling pulls the mask portion 22 upward and over their face. When they finish, they may tuck the mask portion into the torso portion as depicted in FIG. 2. The pointed nature of the neck opening 16 forces the mask portion 22 outward for more comfort of the wearer.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A body and face covering article of clothing comprising:

a body covering comprising a torso portion and two sleeve portions fixedly coupled thereto, said torso portion having a neck opening therein, said body covering comprising a cloth material; and a mask portion being attached to and extending upwardly from an edge of said neck opening, said mask portion comprising a resiliently elastic cloth material, said mask portion being movable between an extended position and a stored position, said extended position being characterized by said mask portion extending upwardly from said neck opening of said torso portion for positioning over the mouth and nose of a wearer, said stored position being characterized by said mask portion extending downward from said neck opening and being tucked into said torso portion.

2. The body and face covering article of clothing as in claim 1, wherein said neck opening tapers to a point in a chest portion of said torso portion.

3. The body and face covering article of clothing as in claim 1, wherein said mask portion includes:

a tubular member having a first end and a second end, said first end of said tubular member extending along and being attached to an edge of said neck opening;

a face portion being attached to and extending upwardly from said second end of said tubular member.

4. The body and face covering article of clothing as in claim 3, wherein said face portion is adapted to cover at least the nose, mouth, cheekbones and lower back head area of a wearer.

5. The body and face covering article of clothing as in claim 1, wherein said mask portion has an upper edge and a front and rear, wherein a distance between said neck opening of said torso portion and said upper edge of said mask portion at the front of said mask portion is approximately twice a distance at the rear of said mask portion.

6. A body and face covering article of clothing comprising:

a body covering comprising a torso portion and two sleeve portions fixedly coupled thereto, said torso portion having a neck opening therein, said neck opening tapering to a point in a chest portion of said torso portion such that said neck opening has a teardrop shape, said body covering comprising a cloth material; and a mask portion being attached to and extending upwardly from an edge of said neck opening, said mask portion being positionable between an extended position and a stored position, said extended position extending upwardly from said torso portion, said stored position extending downward and tucked into said torso portion, said mask portion includes;

a tubular member having a first end and a second end, said first end of said tubular member extending along and being attached to an edge of said neck opening, said tubular member having a length between said first and second ends generally between 2 inches and 4 inches;

a face portion being attached to and extending upwardly from said second end of said tubular member, said face portion adapted to cover at least the nose, mouth, cheekbones and lower back head area of a wearer;

said mask portion comprising a resiliently flexible cloth material.

* * * * *